US006407625B1

(12) United States Patent
Litmanen

(10) Patent No.: US 6,407,625 B1
(45) Date of Patent: Jun. 18, 2002

(54) METHOD AND SYSTEM FOR GENERATING MULTIPLE BIAS CURRENTS

(75) Inventor: Petteri M. Litmanen, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/732,138

(22) Filed: Dec. 7, 2000

Related U.S. Application Data

(60) Provisional application No. 60/172,429, filed on Dec. 17, 1999.

(51) Int. Cl.[7] ..... G05F 3/02

(52) U.S. Cl. ..... 327/543; 327/538; 327/539; 323/312

(58) Field of Search ..... 327/538, 539, 327/543; 323/312, 315

(56) References Cited

U.S. PATENT DOCUMENTS 5,440,277 A * 8/1995 Ewen et al. ..... 327/538
5,631,600 A * 5/1997 Akioka et al. ..... 327/543
5,818,294 A * 10/1998 Ashmore, Jr. ..... 327/543
5,910,749 A * 6/1999 Kimura ..... 327/539
6,075,407 A * 6/2000 Doyle ..... 327/539
6,157,245 A * 12/2000 Rincon-Mora ..... 327/539

* cited by examiner

*Primary Examiner*—Terry D. Cunningham
(74) *Attorney, Agent, or Firm*—William B. Kempler; Dwight N. Holmbo; Frederick J. Telecky, Jr.

(57) ABSTRACT

A method for generating a plurality of enhanced accuracy current slopes includes providing a plurality of current slopes and summing signals indicative of each of the plurality of current slopes to generate a current slope sum. The method also includes generating an enhanced accuracy current slope sum based on the current slope sum and generating the plurality of enhanced accuracy current slopes based on the enhanced accuracy current slope sum such that each respective ratio between each enhanced accuracy current slope and the enhanced accuracy current slope sum is approximately equal to each respective ratio between each signal indicative of the corresponding current slope and the current slope sum.

20 Claims, 3 Drawing Sheets

METHOD AND SYSTEM FOR GENERATING MULTIPLE BIAS CURRENTS

This application claims priority under 35 USC §119(e) (1) of provisional application No. 60/172,429 filed Dec. 17, 1999.

TECHNICAL FIELD OF THE INVENTION

This invention relates generally to electronic circuits and more particularly to a method and system for generating multiple bias currents.

BACKGROUND OF THE INVENTION

Many electronic components include a plurality of devices that require a bias current for optimum operation. Such devices include, for example, low noise amplifiers, filters, mixers, and automatic gain controls. All of these devices may be used in, for example, a wireless phone. The bias current is used to optimize linearity, gain, and noise characteristics of such devices. The bias currents typically vary in a fairly linear fashion with some parameter, such as temperature. Because such currents vary in a fairly linear fashion, they are often referred to as current slopes. These current slopes are provided by a current slope generator. An adjustment circuit is often used with a current slope generator to modify the nominal value of current supplied; however, the slope of the current remains the same regardless of the adjustment circuit.

Because an electronic component may include a plurality of devices requiring biasing, it is often desirable to have a plurality of current slopes available for such an electronic component. However, because each device receiving a bias current may have different operating parameters, it is often desirable to provide bias currents having different slope characteristics for each device.

Current slope generators may be classified into two categories: (1) a single current slope generator, and (2) a multiple current slope generator. Each type of slope generator generally produces a current (or a plurality of currents) that is proportional to a resistance element associated with the current generator. In some instances, the current may be proportional to a single resistor; in others, the current may be proportional to a combination of resistance elements. These resistance elements generally have a tolerance—which means the actual magnitude of resistance may vary with individual resistors. Because the actual value of resistance may vary, and the generated current is proportional to the resistance, the currents generated by current slope generators will have a tolerance equal to that of the associated resistors in the current slope generator.

It is often desirable, however, to provide bias currents having tolerances greater than that available from current slope generators. Therefore, enhancement circuits are utilized. For single slope current generators, an enhancement circuit utilizing a precision resistor is used. Use of this circuit generates a current that has a tolerance equal to that of the precision resistor. In such a system, an external precision resistor is applied to a chip incorporating the current slope generator and the adjustment circuit to provide the increased accuracy. A problem with this type of system, however, is that a single slope generator can produce currents having only a single slope, which is sometimes unacceptable. Multiple slope current generators may also be enhanced. However, according to conventional techniques, a precision resistor is required for each different current slope. In many applications, only one pin is available for receiving a precision resistor. Therefore, it is often impractical to provide a plurality of different current slopes in conjunction with more precise tolerances.

SUMMARY OF THE INVENTION

Accordingly, a need has arisen for an improved method and system for generating multiple bias currents. The present invention provides a system and method for generating multiple bias currents that addresses shortcomings of prior systems and methods.

According to one embodiment of the invention, a method for generating a plurality of enhanced accuracy current slopes includes providing a plurality of current slopes and summing signals indicative of each of the plurality of current slopes to generate a current slope sum. The method also includes generating an enhanced accuracy current slope sum based on the current slope sum and generating the plurality of enhanced accuracy current slopes based on the enhanced accuracy current slope sum such that each respective ratio between each enhanced accuracy current slope and the enhanced accuracy current slope sum is approximately equal to each respective ratio between each signal indicative of the corresponding current slope and the current slope sum.

According to another embodiment of the invention, a system for generating a bias current includes a current slope generator operable to generate a plurality of currents proportional to a resistance value. The resistance value has a tolerance. The system also includes a current adjustor operable to generate a plurality of enhanced accuracy currents bias currents. The current adjustor includes a current transfer circuit operable to receive the plurality of currents and in response generate a current sum. The current adjustor also includes an accuracy enhancer circuit for receiving the current sum and for connection to an enhanced accuracy resistance element. The accuracy enhancer circuit is operable in combination with the enhanced accuracy resistance element to generate an enhanced accuracy current sum through the enhanced accuracy resistance element. The current adjustor also includes a differential voltage isolator for receiving, from the current transfer circuit, at least one differential voltage associated with at least two of the plurality of currents. The differential voltage isolator is operable to generate, based on the enhanced accuracy current sum, a plurality of enhanced accuracy currents corresponding to respective ones of the plurality of currents, each enhanced accuracy current being a proportion of the enhanced accuracy current sum that is approximately equal to the proportion that the corresponding current is of the current sum. The current adjustor also includes a current slope applier operable to receive the signals indicative of the plurality of enhanced accuracy currents and generate corresponding currents for use as the bias currents.

Embodiments of the invention provide numerous technical advantages. For example, in one embodiment of the invention, a method is provided for generating a plurality of bias currents having different slopes, but also having increased accuracy. Thus, a single chip having a plurality of devices that require biasing may utilize different biasing slopes for each device while maintaining a high level of accuracy for such biasing. These advantages are utilized while, at the same time, utilizing only one pin on a chip for a single precision resistor.

Other technical advantages are readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Embodiments of the present invention and its advantages are best understood by referring to FIGS. 1 through 5 of the drawings, like numerals being used for like and corresponding parts of the various drawings.

Figure 1:
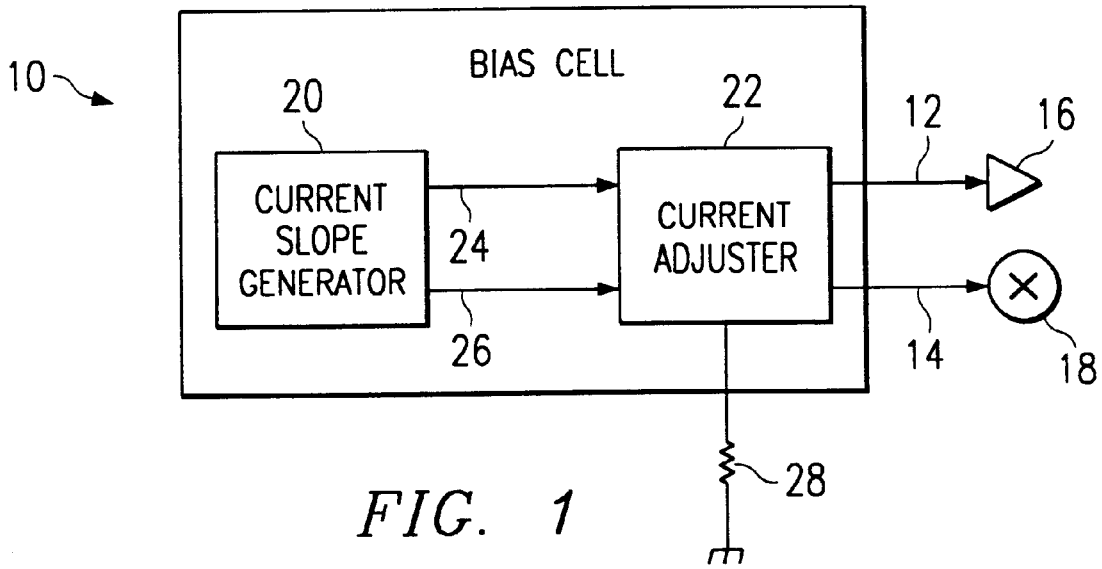
FIG. 1 is a block diagram showing a bias cell according to the teachings of the present invention and a plurality of devices receiving bias currents.

FIG. 1 is a block diagram showing a bias cell 10 for use in generating current slopes 12 and 14. Bias current 12 has a slope that is different from bias current 14. In this example application, bias current 12 is provided to a low noise amplifier 16, and bias current 14 is provided to a mixer 18. Bias currents 12 and 14 may be used to optimize the linearity, gain, and noise characteristics of low noise amplifier 16 and mixer 18, respectively. The magnitude of first bias current 12 and second bias current 14 vary with a parameter, such as in this example, temperature. Therefore, first and second bias currents 12 and 14 are also referred to as current slopes. Bias cell 10, low noise amplifier 16, and mixer 18 may form a part of electronic component, such as a cell phone.

To produce bias currents 12 and 14 bias cell 10 uses a current slope generator 20 and a current adjustor 22. Current slope generator 20 produces current slopes 24 and 26. Current slope 24 has a slope that is different than current slope 26. Current slope generator 20 produces currents that are proportional to an internal resistance of current slope generator 20. Therefore, current slopes 24 and 26 vary with changes in that resistance. Because of differences in resistances due to minor variations in the manufacturing process, current slopes 24 and 26 may vary with such resistance. Therefore, without correction, current slopes 24 and 26 have a tolerance equal to the resistance element contained within current slope generator 20. Although in this example, only two current slopes are shown (24, 26), current slope generator 20 may produce any suitable number of current slopes.

Current slopes 24 and 26 are received by current adjustor 22. In this embodiment, current adjustor 22 performs two functions. First current adjustor 22 adjusts the nominal value for current slopes 24 and 26. For example, the actual value of the current at a nominal temperature is adjusted by current adjustor 22. As an alternative, such adjustment of the nominal value of current slopes 24 and 26 to a desired level may be performed by current slope generator 20. Second, according to the teachings of the present invention, current adjustor 22 increases the accuracy of current slopes 24 and 26 to produce increased accuracy current slopes 12 and 14. As described in greater detail below in conjunction with FIGS. 2 through 5, current adjustor 22 enhances the accuracy of multiple currents having different slopes through the use of a single off-chip resistor, which in this example is precision resistor 28, shown in FIG. 1.

Figure 2:
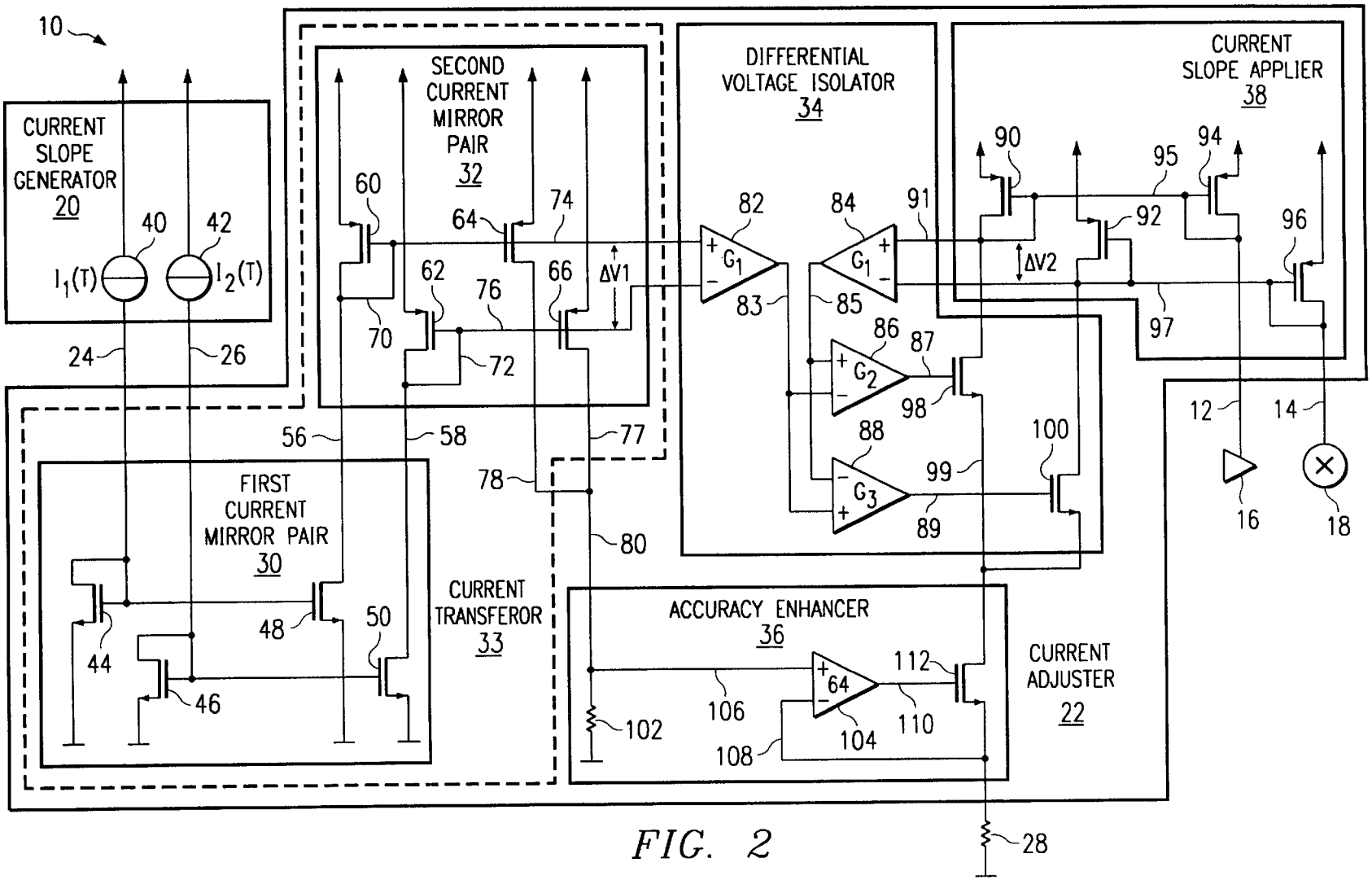
FIG. 2 is a block diagram showing example circuitry associated with one embodiment of a current adjustor of FIG. 1.

FIG. 2 is a block diagram of bias cell 10 illustrated in FIG. 1, showing additional details of the bias cell. As illustrated, bias cell 10 includes a current slope generator 20 and a current adjustor 22. As described above, current slope generator 20 generates current slopes 24 and 26 and provides those current slopes to slope adjustment generator 22. Slope adjustment generator 22 then operates on those slopes to generate current slopes 12 and 14 for use in biasing low noise amplifier 16 and mixer 18, respectively. According to the teachings of the invention, current slopes 12 and 14 have a higher tolerance than current slopes 24 and 26. This higher tolerance results from functions performed by current adjustor 22. Although the illustrated embodiment shows two current slopes 24, 26 received by current adjustor 22 and two current slopes 12, 14 generated by current adjustor 22, the teachings of the invention are applicable to any suitable number of current slopes desired. A current adjustor 22 may also be used to shift a nominal value of current slopes 24, 26 to a desired level in some embodiments. This shifting is implemented by appropriate selection of gains of transistors in a particular portion of current adjustor 22, as described below.

Current adjustor 22, in the illustrated embodiment, includes a number of functional units that cooperate to generate current slopes 12 and 14 having a higher tolerance than current slopes 24 and 26. These functional units include: a current transferor 33, a differential voltage isolator 34, an accuracy enhancer 36, and a current slope applier 38.

Current transferor 30 operates to receive current slopes 24 and 26 and generate a differential voltage ($\Delta V_1$) for receipt by differential voltage isolator 34 at a differential operational amplifier 82. Current transferor 33 also adds current slopes 24 and 26 and provides this combined current sum to accuracy enhancer unit 36. This current sum flows through a resistance element 102 within accuracy enhancer 36. Based on the combined current flowing through resistance element 102, accuracy enhancer 36 generates a higher tolerance combined current through precision resistor 28, resulting in a combined current that has a higher tolerance than the tolerances associated with the current sum flowing through resistance element 102, and therefore, current slopes 24 and 26. The differential voltage ($\Delta V_1$) provided to differential voltage isolator 34 is used to re-apportion the combined current generated through resistor 28 to each of the individual current slopes for providing to low noise amplifier 16 and mixer 18. This re-apportionment is performed by a differential voltage isolator 34. Based on this re-apportionment, current slope applier 38 applies higher tolerance current slopes 12 and 14 to low noise amplifier 16 and mixer 18.

Current transferor 33, in this embodiment, includes a first current mirror pair 30 and a second current mirror 32. First current mirror pair 30 receives current slopes 24 and 26 and mirrors those currents to second current mirror pair 32.

First current mirror pair 30 includes NMOS transistors 44, 46, 48, and 50; however, in other embodiments other types of transistors may be used. Connected to the drain of transistor 48 is a line 56, and connected to the drain of transistor 50 is a line 58. Current slope 24 is mirrored to line 56, and current slope 26 is mirrored to line 58. If desired, the characteristics of the transistors 44, 46, 48, and 50 may be selected to provide suitable gains associated with each current slope; however, in this embodiment, transistors 44, 46, 48, and 50 all have the same characteristics resulting in no gain. For embodiments incorporating more than two current slopes, an additional transistor pair is provided for each current slope. In this example, transistors within first current mirror pair 30 have the same tolerance characteristics.

Second current mirror pair 32 includes PMOS transistors 60, 62, 64, and 66; however, in other embodiments other types of transistors may be used. Second current mirror 32 receives currents on lines 56 and 58 and mirrors those currents onto lines 78 and 79, respectively. The characteristics of transistors 60, 62, 64, and 66 affecting gain may be selected appropriately to provide any suitable gain; however, in this embodiment, transistors 60, 62, 64, and 66 have the same characteristics. In this example, transistors 60, 62, 64, and 66 have the same tolerance characteristics. Such gain may be utilized, for example, to adjust a nominal value of current slopes 12 and 14. As illustrated, the gate of transistor 60 and the gate of transistor 64 are connected and provide a first input to differential amplifier 82. The gate of transistor 62 and the gate of transistor 66 are also connected and provide a second input to differential amplifier 82. A differential amplifier 82 thus receives the difference in gate voltages ($\Delta V_1$) between the transistors associated with current slope 24 (transistor 62 and 64) and the transistors associated with current slope 26 (transistors 62 and 66). This differential voltage is indicative of the relative size of current slopes 24 and 26. The relative size of current slopes 24 and 26 are used by differential voltage isolator 34, as described in greater detail below, in generating currents 12 and 14. Currents through transistors 64 and 66 (lines 78 and 79) are added at line 80, and the resulting current sum is provided to accuracy enhancer 36. For embodiments incorporating more than two current slopes, an additional transistor pair is provided for each current slope and an addition differential voltage associated with each additional current slope is generated.

Accuracy enhancer 36 receives the current sum on line 80 and, response generates a current through resistor 28. Registor 28 is fabricated to a high tolerance to increase the tolerance of currents 12 and 14. The nominal value of resistor 28 may be selected to provide any desired gain. If the nominal value is selected to be equal to the nominal value of resistance element 102 (described below), the current through line 28 is approximately equal to the current sum at line 80. Accuracy enhancer 36 includes a resistance element 102, which may be implemented by one or more resistors. In this example, resistance element 102 is formed from a plurality of resistors having the same nominal value. The tolerance of resistance element 102 is approximately equal to that of the resistance associated with current slope generator 20. One way of constructing resistance element 102 to have a tolerance value approximately equal to that of the resistance associated with current slope generator 20 is to manufacture those resistance elements in proximity to one another. Generally, resistors fabricated in proximity possess the same tolerances and have the same nominal value.

Accuracy enhancer 36 also includes a differential amplifier 104. Differential amplifier 64 receives a voltage on line 106 and a voltage on line 108 as inputs. The voltage on line 106 is equal to the voltage drop across resistance element 102 caused by flow of the combined current at line 80. The voltage on line 108 is the voltage that results from current flow through resistor 28. Differential amplifier 104 has again $G_4$. Accuracy enhancer also includes, in this example, an NMOS transistor 112. The voltage applied on line 110 at the gate of transistor 112 is the differential voltage generated by differential amplifier 104.

As described in greater detail below in conjunction with FIG. 3, accuracy enhancer 36 receives the current sum on line 80 and, in response, generates a current through line 28 that has a tolerance equal to that of the tolerance of resistor 28. This is desirable because tolerances associated with current slope generator 20 are conventionally lower than that of a resistor such as resistor 28. Therefore, use of accuracy enhancer 36 allows for the production of a higher tolerance current than would otherwise be available from current slope generator 20. Because the resulting current through resistor 28 is indicative of the sum of current slopes 24 and 26, differential voltage isolator 34 is used to allocate a proportional portion of the current through resistor 28 to generate current slopes 12 and 14. These resulting currents 12 and 14 have the same tolerance as the current through resistor 28 (which is the tolerance of resistor 28).

Current slope applier 38 cooperates with differential voltage isolator 34 in allocating a proportional portion of the current through resistor 28 to result in current slopes 12 and 14, as described in greater detail below. Current slope applier 38 comprises a current mirror pair having, in this example, PMOS transistors 90, 92, 94, and 96. In this example, the characteristics of transistors 90, 92, 94, and 96 match those of transistors 60, 62, 64, and 66, respectively, and all transistors have the same tolerance. The gates of transistors 90 and 94 are connected and form a first input to a differential amplifier 84. The gates of transistors 92 and 96 are connected and form a second input to differential amplifier 84. The difference between these two inputs is referred to as a $\Delta V_2$. The drains of transistors 90 and 92 are connected to the drains of transistors 98 and 100, respectively, described below. Therefore, the currents through transistors 90 and 92 are the same as the currents through transistors 98 and 100, respectively. In this example, the currents through transistors 90 and 92 are also the same as the currents through transistors 94 and 96, respectively, which are also equal to current slopes 12 and 14, respectively; however the relative sizes of transistors 90, 92, 94, and 96 may be adjusted to provide desired gain.

Differential voltage isolator 34 includes, in this example, four differential amplifiers 82, 84, 86, and 88. Differential voltage isolator 34 also includes two NMOS transistors 98 and 100. In this example, the tolerance of transistors 98 and 100 match that of transistors 44, 46, 48, and 50 in first current mirror pair 30. Transistors 98 and 100 are operated in the linear region to act as resistors, having a resistance controlled by their gate-to-source voltages. Differential amplifiers 82 and 84 have the same gain, represented in this example by $G_1$.

Differential amplifiers 86 and 88 may have the same or different gain. Differential amplifier 82 receives as inputs the voltage on lines 74 and 76 of second current mirror 32. The difference between the voltages on lines 74 and 76 is referred to as ($\Delta V_1$). The output of differential amplifier 82 is provided to line 83. Line 83 provides an input to differential amplifier 86 and an input to differential amplifier 88. The other input to differential amplifiers 86 and 88 are provided by differential amplifier 84 over line 85. Differential amplifier 86 generates an output 87, which provides a gate voltage to transistor 98. Differential amplifier 88 generates an output 89, which provides a gate voltage to transistor 100.

Differential voltage isolator 34 operates to split the current flowing through resistor 28, which has an increased tolerance as described above, into two currents (through transistor 98 and transistor 100) associated with current slopes 24 and 26. This split occurs in the same proportion as the proportions that current slopes 24 and 26 constitute of the sum of those two currents. This procedure is effected through the combination of differential amplifiers 82, 84, 86, and 88 and transistors 98 and 100 as follows: Differential amplifiers 82, 84, 86, and 88 operate to generate a differential voltage across lines 91 and 97 ($\Delta V_2$) that is equal to the differential voltage across lines 74 and 76 ($\Delta V_1$). When the two differential voltages are the same, the relative magnitudes of currents through transistors 98 and 100 are the same as the relative magnitudes of currents 24 and 26. This is so because the characteristics of the transistors in the second current mirror pair match the characteristics of transistor in current slope applier 38. When two pairs of current mirrors such as those illustrated in FIG. 2 have transistors with the same characteristics and have the same differential voltage between the gates of associated pairs, the ratio of the two currents produced by one pair of current mirrors is equal to the ratio of the two currents produced by the other pair of current mirrors.

Generating a differential voltage $\Delta V_2$ that is equal to the differential voltage $\Delta V_1$, occurs as follows: The differential voltage between lines 91 and 97 ($\Delta V_2$) is generated through feedback received from differential amplifiers 86 and 88. Differential amplifiers 86 and 88 each control the gate voltage on transistors 98 and 100, respectively. As described above, transistors 98 and 100 are set to operate in the linear region; thus, they act as resistors, the magnitude of which is controlled by their gate to source voltages. If the differential voltage received by differential amplifier 82 ($\Delta V_1$) differs from the differential voltage received from differential amplifier 84 ($\Delta V_2$), differential amplifiers 86 and 88 generate gate voltages that adjust the resistance values of transistors 98 and 100. Due to changes in the resistance value the proportion of current that flows through transistor 28 is apportioned between transistors 98 and 100 in a proportion determined by $\Delta V_1$, and therefore, the relative size of currents 24 and 26. After a period of time has elapsed, differential amplifier 82 and differential amplifier 84 receive the same differential voltage, and therefore differential amplifiers 86 and 88 make no change to the resistance value of transistors 98 and 100. The resulting currents through transistors 98 and 100 are in the same proportion to each other as currents 24 and 26. The sum of currents through transistors 98 and 100 is equal to the current through resistor 28. The currents flowing through transistors 98 and transistor 100 are then mirrored by current slope applier 38 to result in current slopes 12 and 14.

Thus, by providing a feedback loop within differential voltage isolator 34 that adjusts the resistance of transistors 98 and 100 until the differential voltage received by differential amplifier 84 ($\Delta V_2$) equals the differential voltage received by differential amplifier 82 ($\Delta V_1$), the higher tolerance current flowing through resistor 28 may be apportioned into separate currents in the same proportion as that determined by current slopes 24 and 26, resulting in output currents 12 and 14 having a greater tolerance than provided by current slopes 24 and 26.

The teachings of the invention apply to the generation of any suitable number of current slopes. Example embodiments that utilize N number of current slopes may be implemented by the following changes to the example implementation of FIG. 2: An additional current mirror is added in each component of current transferor 33 for each additional current slope. Thus, for three current slopes (N=3), first current mirror pair 30 is replaced by a first current mirror triplet and second current mirror pair 32 is replaced by a second current mirror triplet. An additional current mirror is also added to current slope applier 38 to each additional current slope. Accuracy enhancer remains unchanged, but receives the sum of signals indicative of all N current slopes through resistance element 102.

Differential voltage isolator 34 is modified to include N−1 differential amplifiers (such as differential amplifiers 82), for receiving voltage inputs from current transferor 33. These additional amplifiers are referred to herein as current transferor receiver amplifiers. One input of all of the current transferor receiver amplifiers receives the gate voltage from a reference pair of transistors from current transferor 33, such as transistors 60 and 64. The other inputs of the current transferor receiver amplifiers are connected in a one-to-one fashion to the remaining transistor pairs associated with respective current slopes. An additional differential amplifier such as differential amplifier 88 is provided for each additional current slope. This additional amplifier is connected to the gate of an additional transistor operating in the linear region such as transistor 100. The additional transistor is connected to the additional current mirror in current slope applier 38 in an analogous fashion to transistors 98 and 100, such as transistors 70 and 72.

Differential voltage isolator 34 is also modified to include N−1 differential amplifiers such as differential amplifier 84 for receiving voltage inputs from pairs of transistors in current slope applier 38 in an analogous fashion. These additional amplifiers are referred to herein as current applier receiver amplifiers. An additional differential amplifier such as differential amplifier 88 is provided for each additional current slope. This additional amplifier is connected to the gate of an additional transistor operating in the linear region such as transistor 100. The additional transistor is connected to the additional current mirror in current slope applier 38 in an analogous fashion to transistors 98 and 100. This additional differential amplifier receives as its positive input the output of a corresponding additional current applier receiver amplifier (analogous to amplifier 82) and receives as its negative input the output of a corresponding additional current applier receiver amplifier (analogous to amplifier 84).

Figure 3:
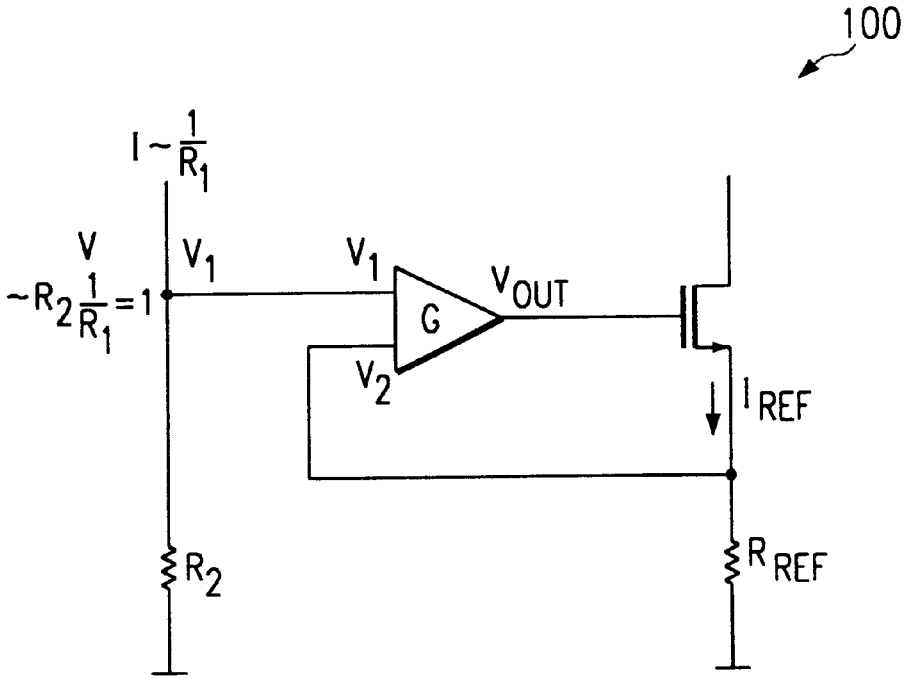
FIG. 3 is a schematic drawing showing example circuitry associated with an accuracy enhancer of FIG. 2.

FIG. 3 is a schematic diagram showing an accuracy enhancer 100 similar to that of accuracy enhancer 36 illustrated in FIG. 2. A description of how accuracy enhancers such as accuracy enhancers 36 and 100 increase the accuracy of a received current is provided below in conjunction with FIG. 3.

Accuracy enhancer 100 receives a current I that is inversely proportional to a resistance $R_1$. In this example, accuracy enhancer 100 includes a resistor $R_2$ connected to ground. $R_2$ is selected to have a tolerance equal to that of $R_1$. Therefore, voltage $V_1$ in FIG. 3 is independent of variation in $R_1$ or $R_2$. In this example, $R_2$ is selected to have a nominal value equal to $R_1$ for convenience. Accuracy enhancer 100 also includes a reference resistor, $R_{REF}$, having a desired tolerance. As shown below, a current $I_{REF}$ through this resistor is generated that is proportional to $V_1$ and has a tolerance equal to that of $R_{REF}$. Accuracy enhancer 100 also includes a high gain differential amplifier that receives as inputs $V_1$ and $V_2$. As demonstrated by the following proof, for high gain, $I_{REF}$ is equal to $V_1/R_{REF}$. Since $V_1$ is not susceptible to changes in $R_1$ or $R_2$, the tolerance of $I_{REF}$ is equal to the tolerance of $R_{REF}$. Thus, by utilizing accuracy enhancer 100, a current having a variation due to manufacturing inaccuracies may be converted into a well-defined current having a desired tolerance. This type of circuit is utilized in the system of FIG. 2 by accuracy enhancer 36. A proof that $I_{REF}=V_1/R_{REF}$ for a high gain differential amplifier is provided below with reference to FIG. 3:

$$V_{out}=G(V_1-V_2)$$

$$V_2=I_{ref}R_{ref}$$

$$I_{ref}=K(V_{out}-V_2)^2$$

$$I_{ref}=K[G(V_1-V_2)-V_2]^2=K[GV_1-GV_2V_2]^2=K[GV_1-(G+1)V_2]^2$$

$$\sqrt{\frac{I_{ref}}{K}}=GV_1-(G+1)V_2=GV_1-(G+1)I_{ref}R_{ref}$$

$$(G+1)R_{ref}I_{ref}+\sqrt{\frac{1}{K}}\sqrt{I_{ref}}-GV_1=0$$

$$\sqrt{I_{ref}}=\frac{\sqrt{\frac{1}{K}}\pm\sqrt{\sqrt{\frac{1}{K}}^2\pm 4(G+1)R_{ref}GV_1}}{2(G+1)R_{ref}}$$

$$\sqrt{I_{ref}}=\frac{-\frac{\sqrt{\frac{1}{K}}}{G}\pm\sqrt{\frac{1}{KG^2}\pm\frac{4G^2R_{ref}V_1}{G^2}+\frac{4R_{ref}GV_1}{G^2}}}{\frac{2GR_{ref}}{G}+\frac{2R_{ref}}{G}}$$

$$\text{If } G\rightarrow\infty,\ \sqrt{I_{ref}}=\pm\frac{2\sqrt{R_{ref}V_1}}{2R_{ref}}=\sqrt{\frac{V_1}{R_{ref}}}$$

$$\Rightarrow I_{ref}=\frac{V_1}{R_{ref}}$$

Figure 4:
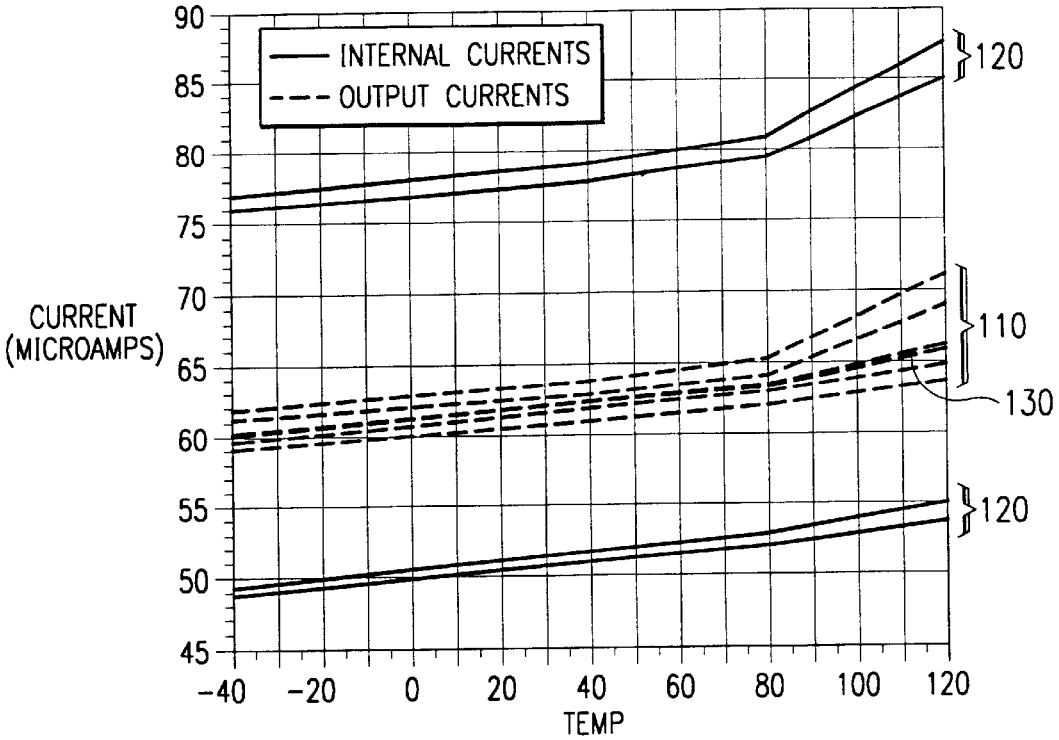
FIG. 4 is a graph of current versus temperature showing an internal current and an output current for the current adjustor of FIG. 1 for a plurality of different conditions for a first current slope.

FIG. 4 is a graph of current versus temperature showing results from a simulation of the system of FIG. 2. Curves 120 represent an internal current on line 79. Curves 110 represent the increased accuracy output current associated with the current on line 79, current slope 14. A curve 130 represents a nominal value for both the internal current on line 79 and output current slope 14. Each of internal current curve 120 represent a variation from the nominal value of curve 130 and the corresponding curves 110 represent the resulting output current slope 14. As illustrated, use of the system of FIG. 2 results in current slopes that have a higher tolerance than that of the currents generated by current slope generator 20—they are grouped in proximity to one another.

Figure 5:
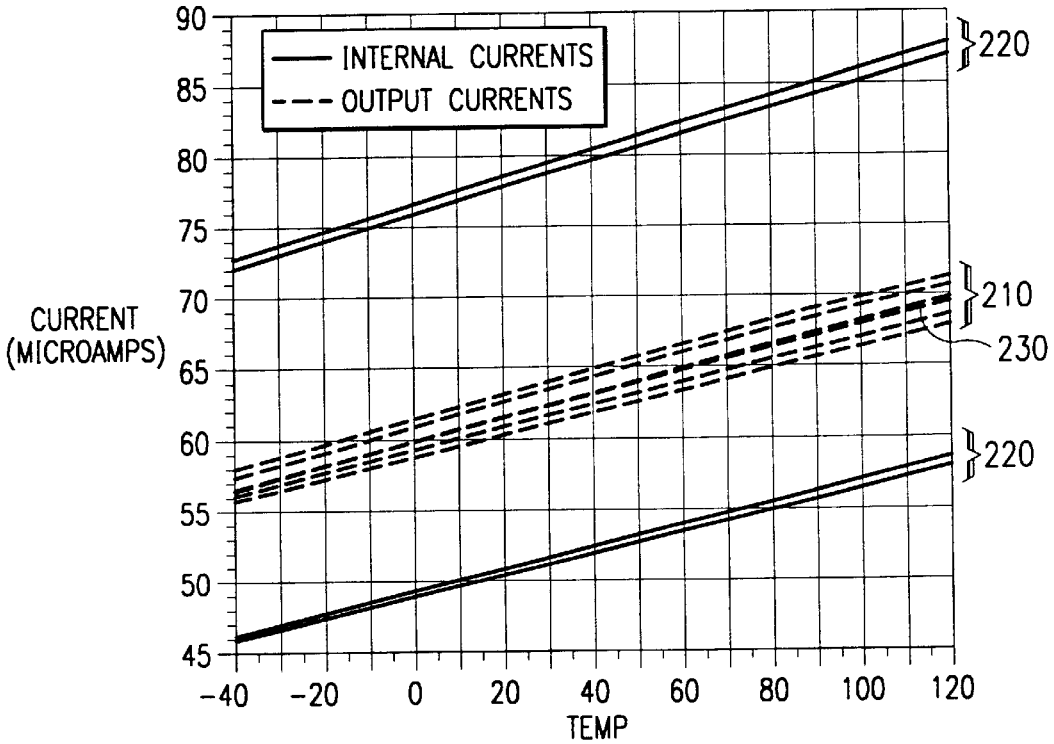
FIG. 5 is a graph of current versus temperature showing an internal and an output current for the current adjustor of FIG. 1 for a plurality of different conditions for a second current slope.

FIG. 5 is a graph of current versus temperature showing current slopes for an internal current on line 78 and output current slope 12. Curves 220 represent internal current on line 78, and curves 210 represent the increased accuracy output current slope associated with the current on line 78, current 12. Curve 230 represents nominal values for the internal current on line 78 and output current 12. As illustrated, use of the system of FIG. 2 results in current slopes that have a higher tolerance than that of the currents generated by current slope generator 20.

Although the present invention and its advantages have been described in detail, it should be understood that various changes, substitutions, and alterations can be made therein without departing from the spirit and scope of the present invention as defined by the appended claims.

What is claimed is:

1. A method for generating a plurality of enhanced accuracy current slopes comprising:

providing a plurality of current slopes;

generating signals indicative of each current slope associated with the plurality of current slopes;

summing the signals indicative of each current slope associated with the plurality of current slopes to generate a current slope sum;

generating an enhanced accuracy current slope sum based on the current slope sum; and generating a plurality of enhanced accuracy current slopes based on the enhanced accuracy current slope sum such that each respective ratio between each enhanced accuracy current slope and the enhanced accuracy current slope sum is approximately equal to each respective ratio between each signal indicative of the corresponding current slope and the current slope sum.

2. The method of claim 1, wherein generating an enhanced accuracy current slope sum based on the current slope sum comprises providing the current slope sum to an accuracy enhancer.

3. The method of claim 1, wherein generating an enhanced accuracy current slope sum based on the current slope sum comprises providing the current slope sum to a circuit having an enhanced accuracy resistor and a resistor having a similar accuracy to a resistance used in generating the plurality of current slopes.

4. The method of claim 1, wherein generating an enhanced accuracy current slope sum comprises generating an enhanced accuracy current slope sum having a tolerance of approximately one percent.

5. The method of claim 1, wherein summing signals indicative of the plurality of current slopes comprises summing, by a plurality of current mirrors, the plurality of current slopes.

6. The method of claim 1, wherein providing a plurality of current slopes comprises providing, by a current slope generator, a plurality of current slopes.

7. The method of claim 1, wherein providing a plurality of current slopes comprises providing a plurality of currents that vary with temperature.

8. The method of claim 1, wherein summing signals indicative of each of the plurality of current slopes comprises summing each of the plurality of current slopes.

9. The method of claim 1, wherein summing signals indicative of each of the plurality of current slopes comprises summing respective products of the current slopes and respective gains associated with each current slope.

10. A system for generating a plurality of bias currents comprising:

a current slope generator operable to generate a plurality of currents proportional to a resistance value, the resistance value having a tolerance; and a current adjustor operable to generate a plurality of enhanced accuracy bias currents, the current adjustor comprising:

a current transfer circuit operable to receive the plurality of currents and in response generate a current sum;

an accuracy enhancer circuit for receiving the current sum and for connection to an enhanced accuracy resistance element, wherein the accuracy enhancer circuit is operable in combination with the enhanced accuracy resistance element to generate an enhanced accuracy current sum through the enhanced accuracy resistance element;

a differential voltage isolator for receiving, from the current transfer circuit, at least one differential voltage associated with at least two of the plurality of currents, the differential voltage isolator operable to generate based on the enhanced accuracy current sum, a plurality of enhanced accuracy currents corresponding to respective ones of the plurality of currents, each enhanced accuracy current being a proportion of the enhanced accuracy current sum that is approximately equal to the proportion that the corresponding current is of the current sum; and a current slope applier operable to receive signals indicative of the plurality of enhanced accuracy currents and generate corresponding currents for use as the bias currents.

11. The system of claim 10, and further comprising the enhanced accuracy resistance element.

12. The system of claim 11, wherein the enhanced accuracy resistance element comprises a single resistor having a tolerance of approximately one percent.

13. The system of claim 10, wherein the current slope generator is operable to produce a plurality of currents each proportional to a first resistance having a first tolerance.

14. The system of claim 13, wherein the accuracy enhancer further comprises a first resistance element having a tolerance approximately equal to the first tolerance.

15. The system of claim 10, wherein the differential voltage isolator comprises a plurality of differential amplifiers and a plurality of associated transistors.

16. The system of claim 10, wherein the current slope applier comprises at least two current mirrors.

17. The system of claim 10, wherein the current transfer circuit comprises a plurality of current mirrors.

18. A method for generating a plurality of enhanced accuracy current slopes comprising:

providing a first number of current slopes having a magnitude proportional to the magnitude of a first resistance having a first tolerance, the first number being at least two;

transferring the current slopes into a second number of differential voltages, the second number being one less than the first number;

summing the current slopes to form a current sum and allowing the current sum to flow through a resistance element having a magnitude approximately equal to that of the first resistance and a tolerance approximately equal to the first tolerance to generate a first voltage having a value independent of the first tolerance;

generating an enhanced accuracy current sum through an enhanced accuracy registor having a tolerance, the enhanced accuracy current sum having a magnitude approximately proportional to the first voltage, the enhanced accuracy current sum also having a tolerance approximately equal to that of the enhanced accuracy resistor; and generating a plurality of enhanced accuracy current slopes based on the enhanced accuracy current sum and the second number of differential voltages, the ratio between each enhanced accuracy current slope and the enhanced accuracy current sum being determined by the plurality of differential voltages and being approximately equal to the ratio between a corresponding one of the current slopes and the current sum.

19. The method of claim 18, wherein the first number is two.

20. The method of claim 18, wherein the tolerance of the enhanced tolerance resistor is one percent.

* * * * *